US010214979B2

(12) United States Patent
Boyd

(10) Patent No.: US 10,214,979 B2
(45) Date of Patent: Feb. 26, 2019

(54) SWIVEL PRESSURE HEAD AND METHOD OF USE

(71) Applicant: Anthony Ray Boyd, New Iberia, LA (US)

(72) Inventor: Anthony Ray Boyd, New Iberia, LA (US)

( * ) Notice: Subject to any disclaimer, the term of this patent is extended or adjusted under 35 U.S.C. 154(b) by 344 days.

(21) Appl. No.: 15/355,804

(22) Filed: Nov. 18, 2016

(65) Prior Publication Data

US 2017/0145789 A1 May 25, 2017

Related U.S. Application Data

(60) Provisional application No. 62/258,252, filed on Nov. 20, 2015, provisional application No. 62/258,865, filed on Nov. 23, 2015, provisional application No. 62/264,627, filed on Dec. 8, 2015.

(51) Int. Cl.
*E21B 21/02* (2006.01)

(52) U.S. Cl.
CPC ..... *E21B 21/02* (2013.01)

(58) Field of Classification Search
CPC .... E21B 21/02; F16L 27/0824; F16L 27/0828
USPC ..... 285/275, 278, 280
See application file for complete search history.

(56) References Cited

U.S. PATENT DOCUMENTS 1,629,650 A * 5/1927 Brauer ..... E21B 21/02 285/280
2,394,800 A * 2/1946 Murphy ..... E21B 21/02 277/563
2,414,997 A * 1/1947 Atkins ..... F16L 27/0824 285/278
2,608,385 A * 8/1952 Stahl ..... E21B 21/02 285/111
2,701,146 A * 2/1955 Warren ..... F16L 39/04 285/121.5
3,601,206 A * 8/1971 Grantom ..... E21B 21/02 175/215
3,877,732 A * 4/1975 Mohaupt ..... F16L 27/0824 285/14
3,913,952 A * 10/1975 Matsui ..... F16L 27/0824 285/281

(Continued)

OTHER PUBLICATIONS

"High PSI Swivel Conversion Kit," Snubco, 2014.
"120-Ton Power Swivel," Logan Oil Tools, Aug. 2012.

*Primary Examiner* — David Bochna
(74) *Attorney, Agent, or Firm* — Jones Walker LLP

(57) ABSTRACT

A swivel pressure head includes a fixation mechanism detachably securing an upper housing to a lower housing. The upper housing includes an internal bore extending from a fluid inlet to an opening on a bottom surface of the upper housing. The lower housing includes a central bore. A pressure sleeve is disposed within the internal bore of the upper housing and within the central bore of the lower housing. A locking nut operatively engages the pressure sleeve and is configured to engage a swivel stem so that rotation of the swivel stem rotates the pressure sleeve. A packing assembly positioned in the internal bore of the upper housing fluidly seals between a wall of the internal bore and an outer surface of the pressure sleeve to direct a fluid flow from the internal bore of the upper housing through a fluid inlet and an internal bore of the pressure sleeve.

22 Claims, 9 Drawing Sheets

(56) References Cited

U.S. PATENT DOCUMENTS

| | | | | |
|---|---|---|---|---|
| 6,007,105 | A * | 12/1999 | Dietle | F16L 27/0828<br>277/559 |
| 9,845,879 | B2 * | 12/2017 | Dietle | F16L 27/0828 |
| 2007/0158112 | A1 * | 7/2007 | Schapel | E21B 21/02<br>175/195 |

* cited by examiner

SWIVEL PRESSURE HEAD AND METHOD OF USE

CROSS-REFERENCE TO RELATED APPLICATIONS

This application claims the benefit of and priority to U.S. Provisional Patent Application No. 62/258,252 filed on Nov. 20, 2015, U.S. Provisional Patent Application Ser. No. 62/258,865 filed on Nov. 23, 2015, and U.S. Provisional Patent Application Ser. No. 62/264,627 filed on Dec. 8, 2015, each of which is fully incorporated herein by reference.

DETAILED DESCRIPTION OF THE INVENTION

In the petroleum industry, power swivels are used to provide rotation for tubular members disposed in a wellbore. Swivels can be used to rotate a drill string on a workover rig or for any other operation in which rotation of a tubular member is required. A power swivel includes a swivel head attached to a swivel motor. The swivel head has a fluid inlet that allows for the introduction of a fluid into the drill string being rotated by the swivel. In some operations, it is preferred or required that the fluid is introduced into the drill string under pressure. Other types of swivels do not cause the rotation of the tubular member; instead, the swivel is used for the introduction of a fluid into the drill string while a separate component, such as a kelly drive or rotary table, causes rotation of the tubular member.

Figure 1:
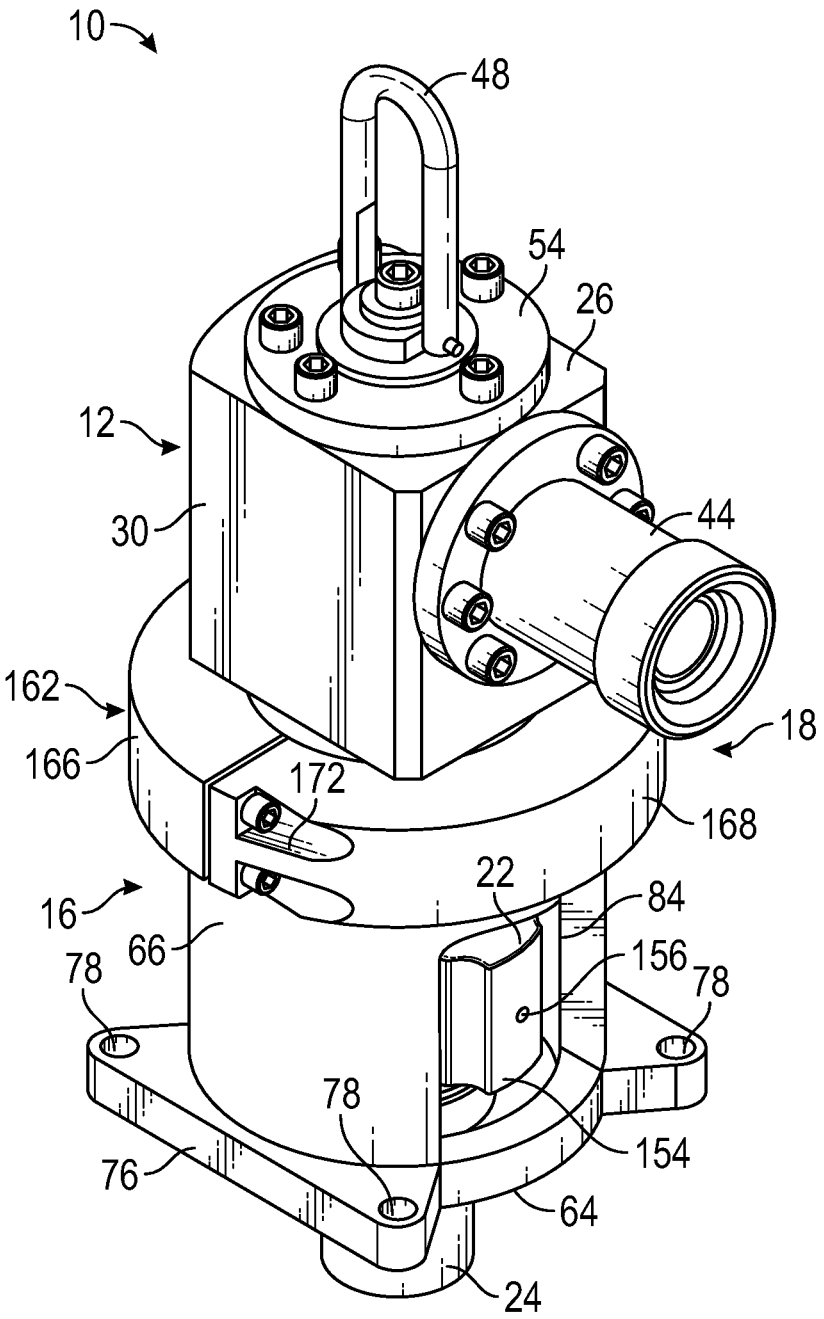
FIG. 1 is a perspective view of an embodiment of a high-pressure swivel pressure head.
Figure 2:
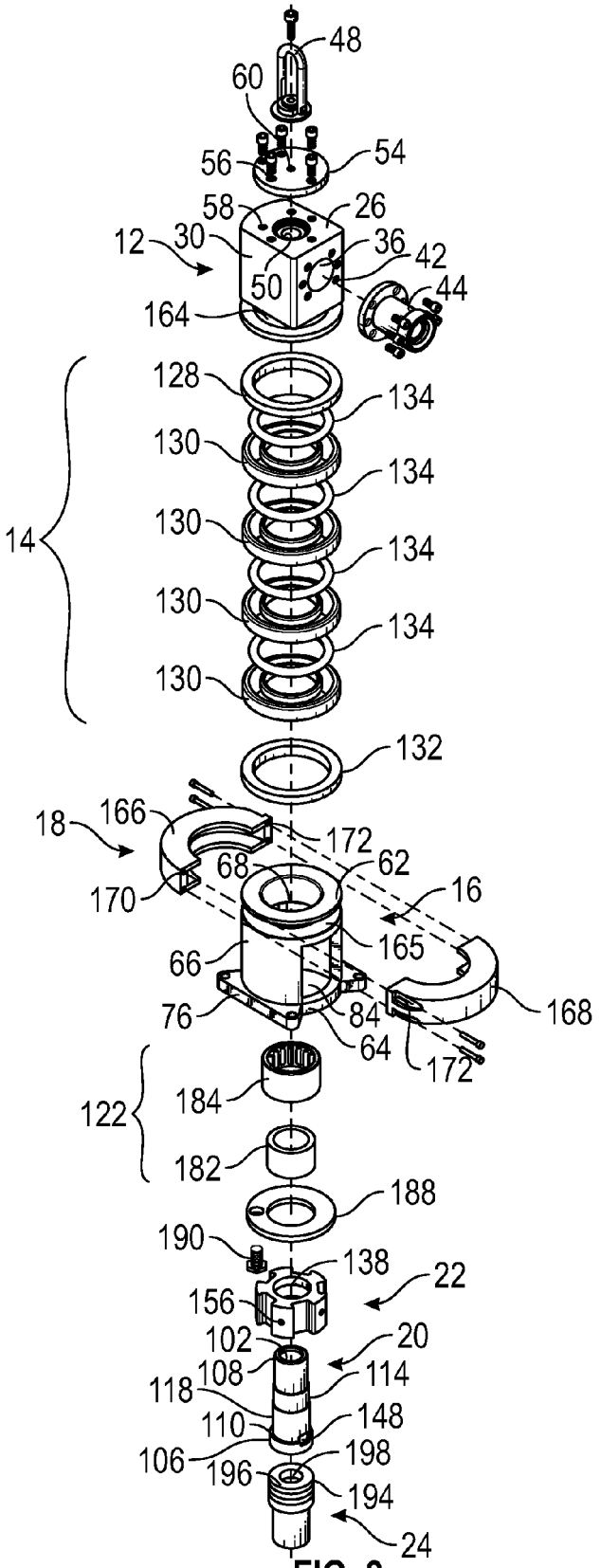
FIG. 2 is an exploded view of the high-pressure swivel pressure head shown in FIG. 1.
Figure 3:
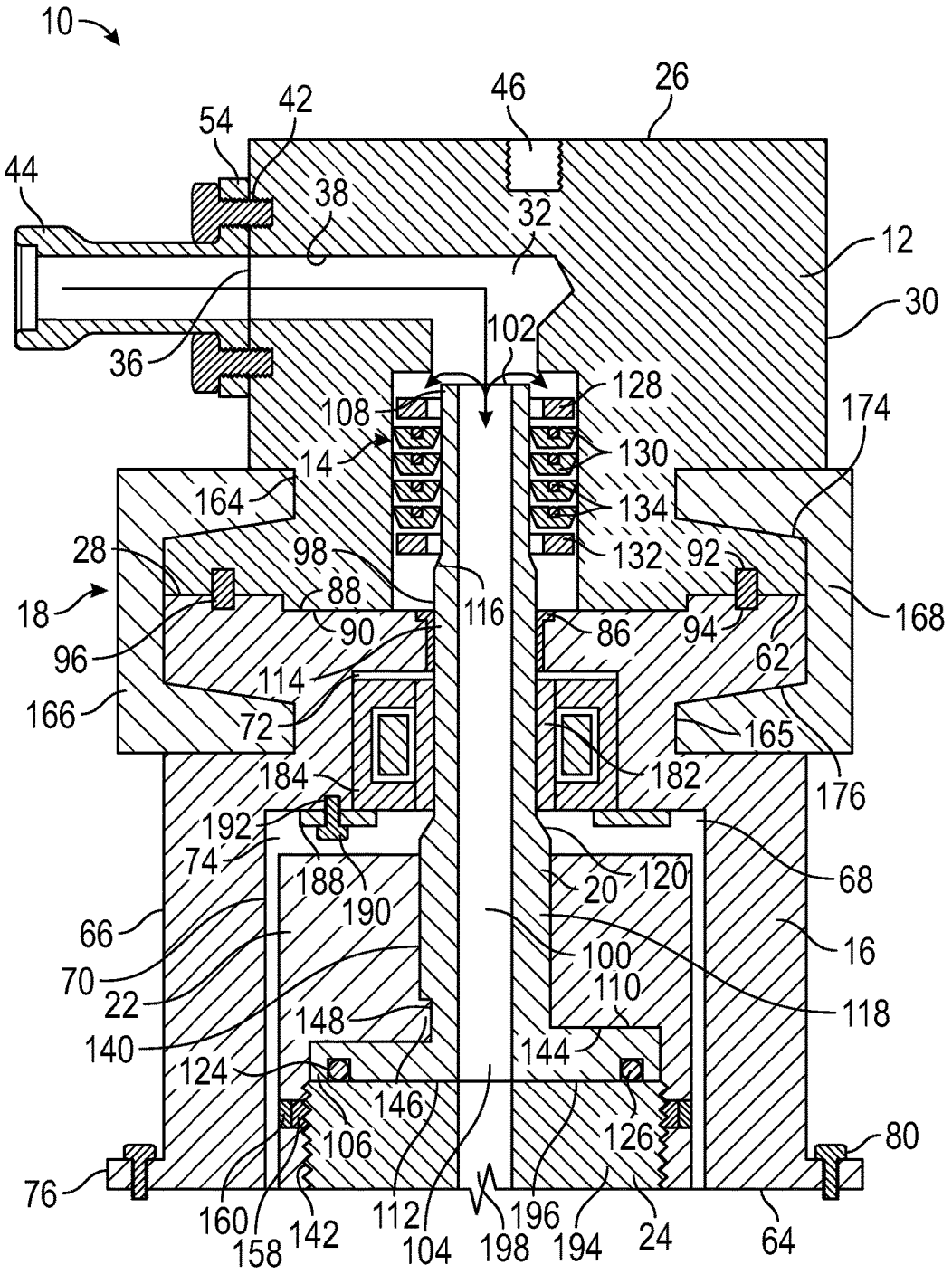
FIG. 3 is a cross-sectional view of the high-pressure swivel pressure head shown in FIGS. 1 and 2.
Figure 4:
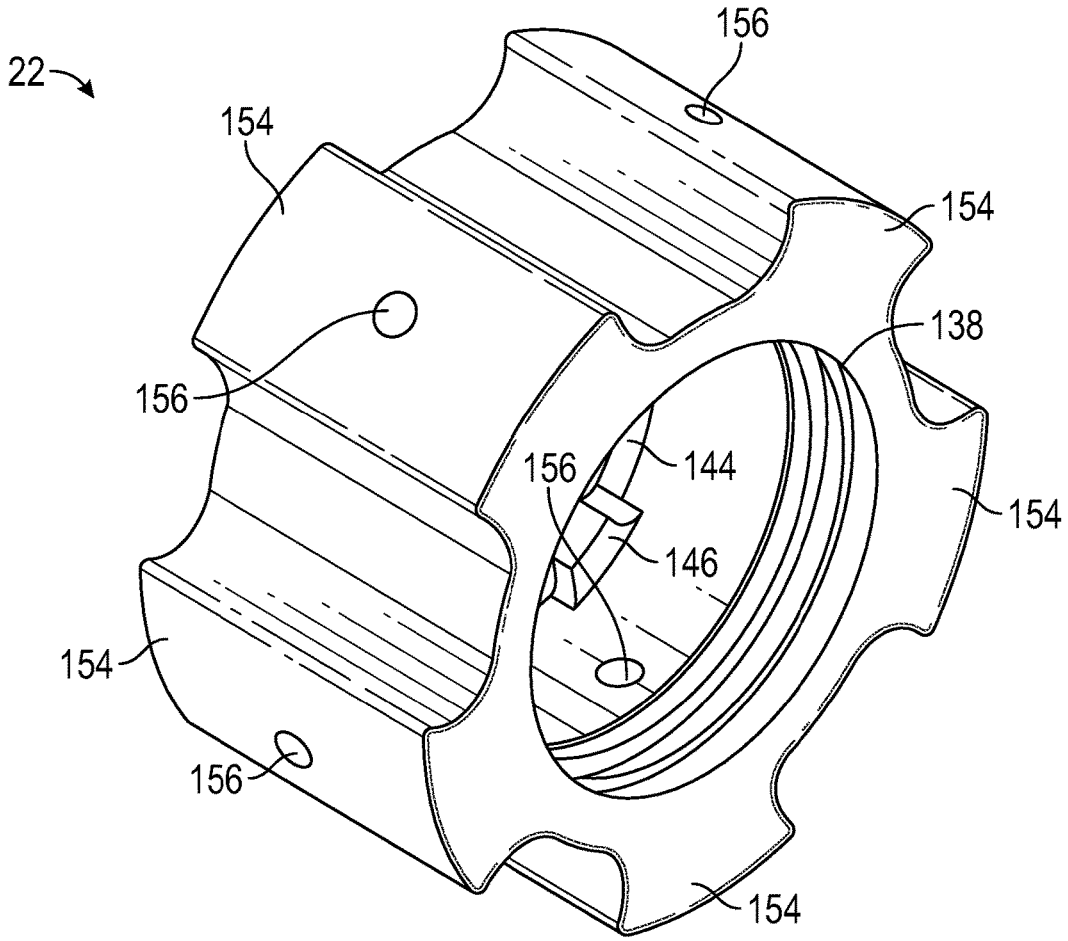
FIG. 4 is a perspective view of one embodiment of a locking nut of the high-pressure swivel pressure head.

A swivel pressure head is described herein. As shown in FIGS. 1-3, high-pressure swivel pressure head 10 includes an upper housing 12, a packing assembly 14, a lower housing 16, a fixation mechanism 18, a pressure sleeve 20, and a locking nut 22. The upper housing 12 is removably affixed to the lower housing 16 through fixation mechanism 18. The packing assembly 14 is disposed within the upper housing 12 and provides a fluid seal between pressure sleeve 20 and upper housing 12. The pressure sleeve 20 is disposed within the upper housing 12 and the lower housing 16. Locking nut 22 is removably affixed to the pressure sleeve 20 and to a swivel stem 24. Locking nut 22 engages the pressure sleeve 20 and swivel stem 24 so that rotation of the swivel stem 24 rotates the locking nut 22 and the pressure sleeve 20. In one embodiment, the pressure sleeve 20, upper housing 12, and lower housing 16 are formed of iron.

Upper housing 12 includes a top surface 26, a bottom surface 28, interconnecting side surface 30, an internal bore 32, and a fluid inlet 36. Top surface 26 is connected to the bottom surface 28 through the interconnecting side surface 30. In one embodiment, top surface 26, bottom surface 28, and interconnecting side surface 30 are integrally formed. The internal bore 32 is formed with an internal bore wall 38. The internal bore 32 extends from the fluid inlet 36 to the bottom surface 28 of the upper housing 12. A fluid introduced into the fluid inlet 36 flows through internal bore 32. Because the upper housing 12 does not include a restricted inner diameter below the internal bore 32, the surface of the internal bore wall 38 may be more easily repaired. This also allows for the packing assembly 14 to be inserted into the upper housing 12 without deformation of the packing assembly 14 components.

In one embodiment, the upper housing 12 includes bolt recesses 42 about the fluid inlet 36. A weco flange 44 may removably affixed to the fluid inlet 36 with bolts positioned through bolt bores in the weco flange 44 and the bolt recesses 42 of the upper housing 12. The weco flange 44 allows the upper housing 12 to be connected to the fluid line from a pump.

In one embodiment, top surface 26 includes a recess 46 for receiving a lifting eye 48, as shown in FIG. 3. In other embodiments, such as those shown in FIGS. 1, 2, 5, and 6, top surface 26 includes a second fluid inlet 50. In this embodiment, when the second fluid inlet 50 is not in use, a lifting eye 48 or plug 52 may be positioned within the second fluid inlet 50. A wireline may be inserted through second fluid inlet 50. As shown in FIGS. 1 and 2, in a further embodiment, a flange 54 may be disposed over the second fluid inlet 50. The flange 54 includes bore 56 to receive bolts to mount the flange 54 to the top surface 26. In this embodiment, the top surface 26 includes bores 58 to receive the bolts for the mounting of the flange. A lifting eye 48 is then mounted to the flange 54 through a central bore 60 in the flange 54. In embodiments that include a lifting eye 48, the lifting eye 48 could either be left on the swivel pressure head during work or it may be removed before work is started to prevent the lifting eye 48 from interfering with other equipment.

Lower housing 16 includes a top surface 62, a bottom surface 64, an interconnecting side surface 66, and a central bore 68. The top surface 62 and bottom surface 64 are connected through the interconnecting side surface 66. In one embodiment, the top surface 62, bottom surface 64, and interconnecting side surface 66 are integrally formed. The central bore 68 of the lower housing 16 extends from the top surface 62 of the lower housing 16 to the bottom surface 64 of the lower housing 16. The central bore 68 of the lower housing 16 is formed by a central bore wall 70 in the lower housing 16. The central bore 68 of the lower housing 16 includes a reduced diameter upper section 72 and an enlarged diameter lower section 74. The pressure sleeve 20 extends through the central bore 68 in the lower housing 16 and extends into the internal bore 32 of the upper housing 12. Lower housing 16 also includes a flange 76 on the bottom surface 64. The flange 76 has bores 78 for receiving bolts 80 to removably mount the lower housing 16 on a swivel motor housing 82 (shown in FIG. 8).

In one embodiment, the interconnecting side surface 66 of the lower housing 16 includes an opening 84. When the swivel pressure head 10 is assembled, the opening 84 allows access to the locking nut 22 so that the locking nut 22 may be tightened about the swivel stem 24.

In one embodiment, the lower housing 16 includes an aligning ring 86. The aligning ring 86 is positioned within the central bore 68 of the lower housing 16 at the top surface 62. In one embodiment, the aligning ring 86 is a brass ring. The aligning ring 86 is positioned so that it is near or in contact with pressure sleeve 20 when the swivel pressure head 10 is assembled. Aligning ring 86 may serve as a bushing to prevent damage to the lower housing 16 and the pressure sleeve 20 as the pressure sleeve 20 rotates within the lower housing 16. Aligning ring 86 also aligns the pressure sleeve 20 within the upper and lower housings 12, 16.

In one embodiment, bottom surface 28 of the upper housing 12 includes extended surfaces 88 that engage a recessed surface 90 on the top surface 62 of lower housing 16. In other embodiments, the top surface 62 of the lower housing 16 has extended surfaces that engage recessed surfaces located on the bottom surface 28 of the upper housing 12.

In one embodiment, bottom surface 28 of upper housing 12 and the top surface 62 of lower housing 16 both include recesses 92, 94 for alignment pins 96. An alignment pin 96 is positioned in each recess 92, 94 to prevent relative rotation between the upper housing 12 and the lower housing 16. In one embodiment, alignment pins 96 are between ½ inch and 1 inch in length, such as approximately ¾ inch long. In another embodiment, alignment pins 96 are formed of stainless steel. In yet another embodiment, the alignment pins 96 are secured within the recess 92 in the upper housing 12 with an adhesive. In still another embodiment, the alignment pins 96 are secured within the recess 94 in the lower housing 16 with an adhesive. In another embodiment, the swivel pressure head 10 includes a plurality of alignment pins 96.

The pressure sleeve 20 has a cylindrical outer surface 98, an internal bore 100, an upper fluid inlet 102, and a fluid outlet 104. The internal bore 100 of the pressure sleeve 20 extends from the upper fluid inlet 102 to the fluid outlet 104. In one embodiment, the internal bore 100 of the pressure sleeve 20 has the same diameter as the fluid inlet 36 of the upper housing 12. In other embodiments, the diameter of the internal bore 100 of the pressure sleeve 20 may be smaller than the diameter of the fluid inlet 36 of the upper housing 12. In another embodiment, the internal bore 100 of the pressure sleeve 20 may be from ½ inch to 5 inches in diameter. In yet another embodiment, the internal bore 100 of the pressure sleeve 20 has a diameter of approximately 2 inches. The diameter of the internal bore 100 is limited by the size of the pump used; the larger the diameter of the internal bore 100, the larger the pump needs to be to create the same amount of pressure. The pressure sleeve 20 includes an enlarged outer diameter bottom section 106 and a reduced outer diameter extension section 108. The enlarged outer diameter bottom section 106 includes a top shoulder surface 110 and a bottom surface 112. In one embodiment, the reduced outer diameter extension section 108 of the pressure sleeve 20 includes a middle section 114 having a shoulder surface 116. The middle section 114 has an outer diameter that is larger than the diameter of the upper end of the pressure sleeve 20 but smaller than the diameter of the enlarged outer-diameter bottom section 106. In another embodiment, the reduced outer diameter extension section 108 of the pressure sleeve 20 includes a second middle section 118 having a second shoulder surface 120. The second middle section 118 has an outer diameter that is larger than the diameter of the middle section 114 but smaller than the diameter of the enlarged outer-diameter bottom section 106. The shoulders 116, 120 that are formed by the differing diameters of the pressure sleeve 20 allow the swivel pressure head 10 to be assembled by sizing parts so that they engage the appropriate shoulders. In one embodiment, the packing assembly 14 engages shoulder 116, a bearing assembly 122 engages the second shoulder 120, and the locking nut 22 engages the top shoulder surface 110 of the enlarged-diameter bottom section 106. In another embodiment, there is only one middle section 114 and the shoulder surface 116 of the middle section 114 engages the bearing assembly 122. In still another embodiment, there are no middle sections. In one embodiment, pressure sleeve 20 has a minimum wall thickness of approximately ½ inch.

In one embodiment, pressure sleeve 20 may include a circumferential recess or groove 124 in the bottom surface 112 of the enlarged outer diameter bottom section 106. In this embodiment, an o-ring 126 is positioned within the circumferential recess or groove 124. The o-ring 126 provides a fluid seal between the pressure sleeve 20 and swivel stem 24.

Figure 5:
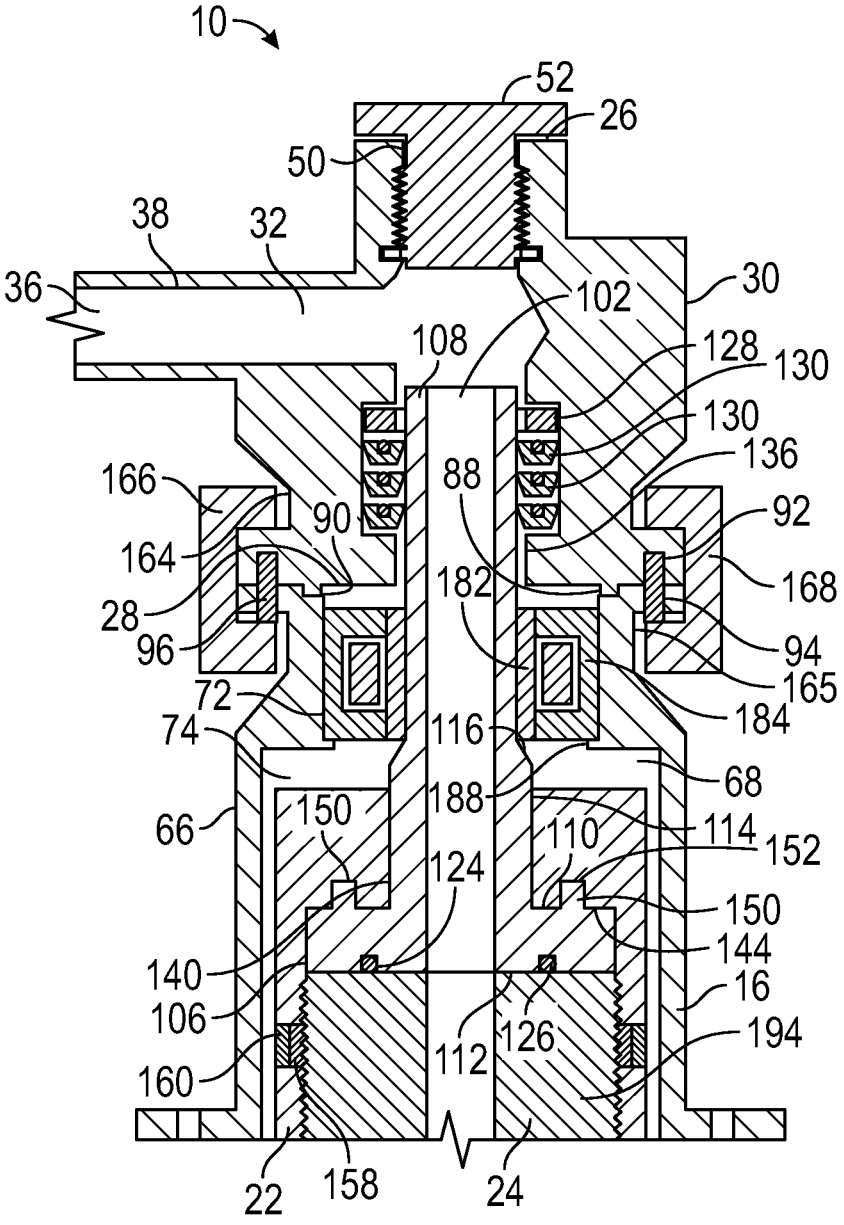
FIG. 5 is a cross-sectional view of an alternate embodiment of a high-pressure swivel pressure head.
Figure 6:
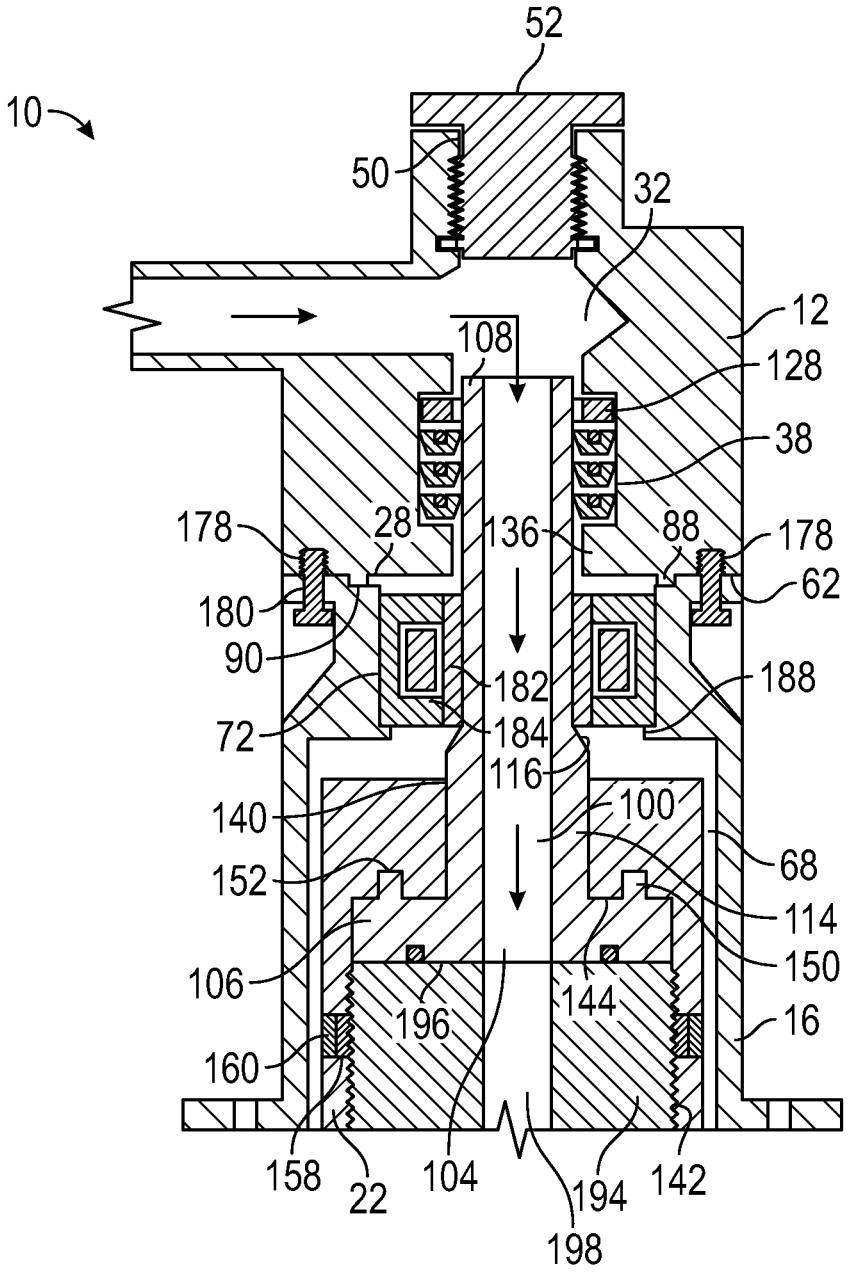
FIG. 6 is a cross-sectional view of a second alternate embodiment of a high-pressure swivel pressure head.

The swivel pressure head 10 includes the packing assembly 14 positioned in the internal bore 32 of the upper housing 12. Packing assembly 14 provides a fluid seal between the internal bore wall 38 of the upper housing 12 and the outer cylindrical surface 98 of the pressure sleeve 20. In one embodiment, packing assembly 14 includes a spacer ring 128, a plurality of packing rings 130, and a lower retention ring 132. The spacer ring 128 prevents any turbulence caused by the fluid pressure from affecting the packing rings 130. In one embodiment, and as shown in FIGS. 2 and 3, the packing assembly 14 includes four packing rings 130. In other embodiments, and as shown in FIGS. 5 and 6, the packing assembly 14 includes a spacer ring 128 and a plurality of packing rings 130. In this embodiment, the packing assembly 14 may include three packing rings 130. In one embodiment, packing rings 130 include o-rings 134 (which help push the side walls of the packing rings 130 out to engage the internal bore wall 38). The packing assembly 14 is disposed about the reduced outer diameter extension section 108 of the pressure sleeve 20 when pressure sleeve 20 is positioned within the upper housing 12. In one embodiment, the spacer ring 128 is a brass ring, the packing rings 130 are sealing rings, and the lower retention ring 132 is a brass ring. In another embodiment, the lower retention ring is a Teflon ring. As fluid flows through the fluid inlet 36 and internal bore 32 of the upper housing 12, most of the fluid will enter the upper fluid inlet 102 of the pressure sleeve 20. However, a portion of the fluid will flow to and partially through the packing assembly 14. The downward force exerted by the fluid will cause the packing rings 130 to expand and provide a fluid seal between the internal bore wall 38 and the outer cylindrical surface 98 of the pressure sleeve 20. In one embodiment, the packing assembly 14 is installed through the bottom of the upper housing 12.

In one embodiment shown in FIGS. 5 and 6, the upper housing 12 includes a circumferential shoulder 136 about the internal bore 32. In this embodiment, the circumferential shoulder 136 assists in retaining the packing assembly 14 in the upper housing 12. In other embodiments, the upper housing 12 does not include this circumferential shoulder 136.

The pressure sleeve 20 is secured to the swivel stem 24 with locking nut 22. Locking nut 22 includes an internal bore 138 that extends through the locking nut 22. The internal bore 138 includes an upper portion 140 and a lower portion 142. The upper portion 140 of the internal bore 138 is sized to receive the reduced outer-diameter extension section 108 of the pressure sleeve 20. The lower portion 142 of the internal bore 138 is sized to receive the enlarged outer-diameter bottom section 106 of the pressure sleeve 20. The locking nut 22 includes shoulder 144 by the interface between the upper portion 140 and lower portion 142 of the internal bore 138. The lower portion 142 of the internal bore 138 includes threads for engaging swivel stem 24. The shoulder 144 of locking nut 22 engages the top shoulder surface 110 of the enlarged outer diameter bottom section 106 of pressure sleeve 20 such that the pressure sleeve 20 rotates with a rotation of the locking nut 22. In one embodiment, the locking nut 22 and pressure sleeve 20 engage one another through a reciprocal key and recess arrangement. In a further embodiment, the locking nut 22 includes a key 146 formed in the upper portion 140 of the internal bore 138 and the pressure sleeve 20 includes a reciprocal recess 148 in the top shoulder surface 110 of the enlarged outer diameter bottom section 106 for receiving the key 146. In other embodiment shown in FIGS. 5-7, the top shoulder surface 110 of the enlarged outer diameter bottom section 106 of pressure sleeve 20 includes a key 150 and the shoulder 144 of locking nut 22 includes a reciprocal recess 152 that receives the key 150.

In one embodiment, locking nut 22 includes wings 154 extending outwardly from the center of the locking nut 22. In a further embodiment, the wings 154 include bores 156 that extend from the exterior of the wing 154 to the lower portion 142 of the internal bore 138 of the locking nut 22. Once the locking nut 22 is threadedly attached to the swivel stem 24, retaining plugs 158 are positioned in the bores 156 in the wings 154. Then allen screws 160 are placed in the bores 156 and are used to tighten the retaining plugs 158 against the threads of the swivel stem 24. In one embodiment, retaining plugs 158 are Teflon. The retaining plugs 158 help to retain the torque on the swivel stem 24.

The fixation mechanism 18 removably attaches the upper housing 12 to the lower housing 16. In one embodiment, fixation mechanism 18 is a clamp 162, as shown in FIGS. 1-3 and 5. If a clamp 162 is used, upper housing 12 includes a first clamp recess 164 about the exterior of interconnected side surface 30 and lower housing 16 includes a second clamp recess 165 about the exterior of interconnecting side surface 66. In one embodiment, clamp 162 includes two semicircular members 166, 168 that are removably fastened together. Both the first and second members 166, 168 are shaped to fit about the upper and lower housing clamp recesses 164, 165. The first and second members 166, 168 each includes at least two bores 170 on one end and at least two bolt recesses 172 located on the opposite end. Bolts are positioned within the bores 170 of the first member 166 and the bolt recesses 172 of the second member 168 in a retaining engagement. Additional bolts are positioned within the bores 170 of the second member 168 and the bolt recesses 172 of the first member 166 in a retaining engagement.

In some embodiments, the upper inner surface 174 and lower inner surface 176 of the clamp members 166, 168 are inclined. In this embodiment, the clamp recesses 164, 165 on the upper housing 12 and lower housing 16 are reciprocally inclined and the inclined surfaces 174, 176 of the clamp 162 engage and compress the reciprocally inclined surfaces of the clamp recesses 164, 165. This reciprocally inclined surface arrangement may also prevent or reduce vibration and/or movement of the upper housing 12 and lower housing 16 during rotation of pressure sleeve 20. Use of a clamp 162 as the fixation mechanism 18 provides for quicker assembly and disassembly of the swivel pressure head 10 than in a conventional flange and bolt connection arrangement.

Figure 7:
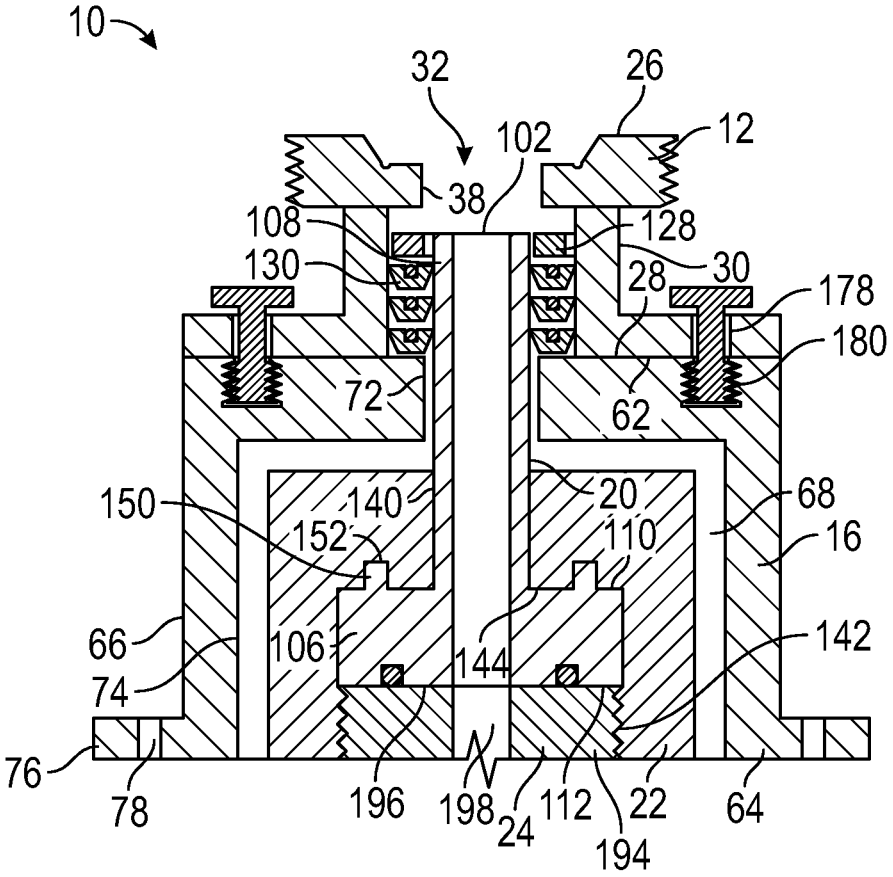
FIG. 7 is a cross-sectional view of a third alternate embodiment of a high-pressure swivel pressure head.

In other embodiments, the fixation mechanism includes bolts and bores, as shown in FIGS. 6 and 7. In these embodiments, the bottom surface 28 of the upper housing 12 includes at least two bolt receiving bores 178 and the top surface 62 of the lower housing 16 includes at least two bolt receiving bores 180. Bolts are disposed through the bolt receiving bores 178, 180 in the bottom surface 28 of the upper housing 12 and the top surface 62 of the lower housing 16 in order to removably attach the upper housing 12 to the lower housing 16.

As shown in FIGS. 2, 3, 5, and 6, in some embodiments, swivel pressure head 10 includes a bearing assembly 122 positioned in the reduced diameter upper section 72 of the central bore 68 of the lower housing 16. The bearing assembly 122 is disposed about pressure sleeve 20 to reduce vibration associated with the rotation of pressure sleeve 20 within the upper housing 12 and lower housing 16. The bearing assembly 122 also reduces the wear from the rotation of the pressure sleeve 20 on the upper housing 12 and lower housing 16. In one embodiment, the bearing assembly 122 includes a race 182 and a needle bearing unit 184. The race 182 is positioned about the pressure sleeve 20. The needle bearing unit 184 is positioned about the race 182. In one embodiment, race 182 may be ¼ inch to ⅜ inch in thickness. In one embodiment, needle bearing unit 184 may be ½ inch in thickness. In operation, the race 182 will rotate with the pressure sleeve 20. The race 182 is attached to the pressure sleeve 20 with an allen screw.

A retainer 188 secures the bearing assembly 122 in the reduced diameter upper section 72 of the central bore 68 of the lower housing 16. In the embodiments shown in FIGS. 5 and 6, the retainer is a circumferential shoulder 188 positioned about the lower end of the reduced diameter upper section 72 of the central bore 68 of the lower housing 16. The bearing assembly 122 is installed from the top end of lower housing 16. The circumferential shoulder 188 engages the lower end of the needle bearing unit 184, which retains the needle bearing unit 184 in the reduced diameter upper section 72 of the central bore 68. In the embodiments shown in FIGS. 2 and 3, the retainer 188 is a washer 188 that is removably attached to the upper end of the enlarged diameter lower section 74 of the central bore 68 of the lower housing 16. The bearing assembly 122 is installed from the bottom end of lower housing 16. The washer 188 has an inner diameter that is less than the diameter of the bearing assembly 122, and an outer diameter that is larger than the diameter of the reduced diameter upper section 72 of the central bore 68 of the lower housing 16. In one embodiment, the washer 188 is removably attached to the upper end of the enlarged diameter lower section 74 of the central bore 68 of the lower housing 16 with a bolt 190 that is positioned through an aperture in the disc of the washer 188 and a bore 192 positioned in the upper end of the enlarged diameter lower section 74 of the central bore 68. The washer 188 engages the lower end of the needle bearing unit 184, which retains the needle bearing unit 184 in the reduced diameter upper section 72 of the central bore 68. In one embodiment, washer 188 is approximately ⅛ inches in thickness.

Figure 8:
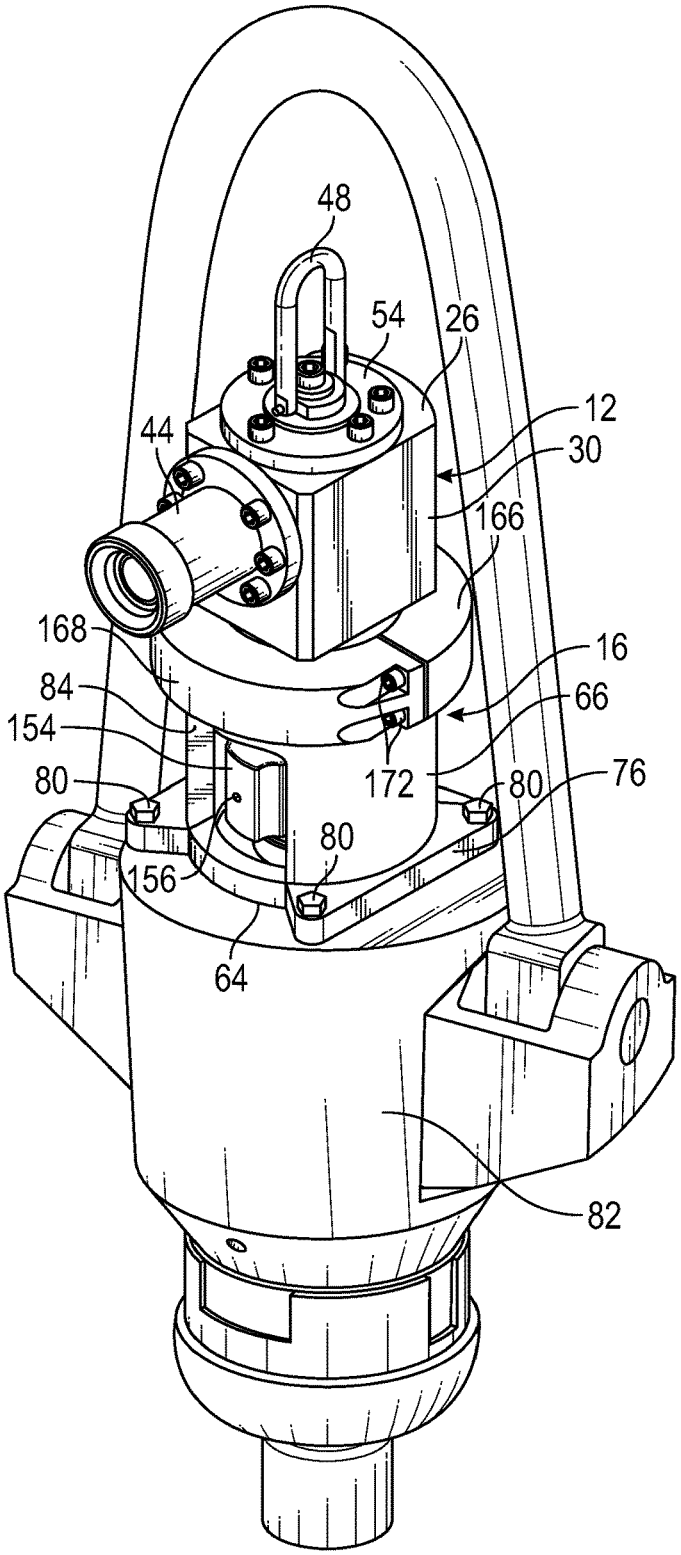
FIG. 8 is a perspective view of an embodiment of the high-pressure swivel pressure head attached to a swivel motor.
Figure 9:
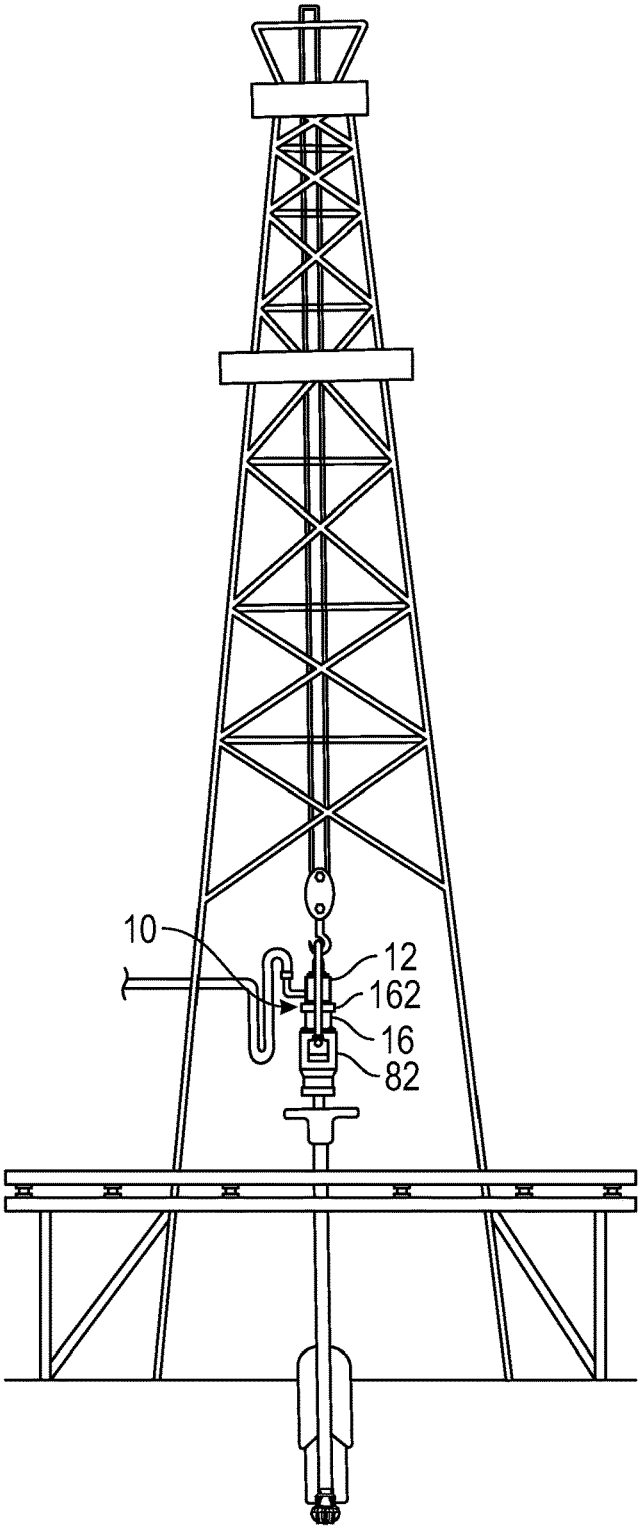
FIG. 9 is a schematic view of a high-pressure swivel pressure head mounted to a swivel motor and in use on a derrick.

The locking nut 22 engages the pressure sleeve 20 and swivel stem 24 so that pressure sleeve 20 is rotated within upper housing 12 and lower housing 16 by rotation of the swivel stem 24. The bearing assembly 122 reduces vibration of the pressure sleeve 20 during rotation of pressure sleeve 20. The fixation mechanism 18 and the alignment pins prevent relative rotation between the upper housing 12 and lower housing 16. Additionally, upper and lower housings 16 are prevented from rotating during rotation of the swivel stem 24 and pressure sleeve 20 because of the bolted connection between the lower housing 16 and the swivel. The swivel stem 24 has an upper section 194 with a top surface 196. When the locking nut 22 is tightened about the swivel stem 24, the top surface 196 of the swivel stem 24 is sealingly engaged to the bottom surface 112 of the enlarged outer diameter bottom section 106 of the pressure sleeve 20. The swivel stem 24 includes an internal bore 198 that is in fluid communication with the fluid outlet 104 of the pressure sleeve 20 when the lower portion of the locking nut 22 is operatively engaged to the swivel stem 24. The swivel pressure head 10 is prevented from rotating relative to the swivel motor housing 82 through the connection of bolts 80 to the flange 76 in the lower housing 16, as shown in FIG. 8.

As fluid flows through the internal bore 32 in the upper housing 12, the fluid exerts an upward force on the upper housing 12. The swivel pressure head 10 allows for higher fluid pressure than conventional swivels due to the anchoring of the upper and lower housings 12, 16 to the swivel motor housing 82. Additionally, in embodiments where the fixation mechanism 18 is a clamp 162, the clamp 162 also contributes to the higher pressure allowance of the swivel pressure head 10. The higher pressure allowance of the swivel pressure head 10 allows for use on a workover rig and for swivel applications that are conventionally limited to more costly coiled tubing work.

The swivel pressure head 10 disclosed herein can be left on the swivel motor housing 82 at all times. The swivel pressure head 10 can be used both in high pressure and low pressure applications. While the swivel pressure head 10 cannot be used with coil tubing, the swivel pressure head 10 can be used in the same applications as coil tubing and allows an operator to reach further depths and/or distances within a wellbore than achieved with coil tubing. The swivel pressure head 10 may be used on both drilling and workover rigs. The swivel pressure head 10 may be used with power swivels that cause rotation of a tubular string or with swivels that do not cause the rotation of the tubular string. The swivel pressure head 10 can be used with any fluid, including but not limited to: water, brine water, drilling mud, and corrosive fluids.

To assemble the swivel pressure head 10 and mount it to the swivel motor housing 82, first the locking nut 22 is placed over the pressure sleeve 20. The locking nut 22 is rotated until the key on the locking nut 22 or pressure sleeve 20 engages the reciprocal recess to lock the locking nut 22 in place. If the swivel pressure head 10 includes a bearing assembly 122, the race 182 is then placed on the pressure sleeve 20 and mounted to the pressure sleeve 20 with an allen screw. The locking nut 22 and pressure sleeve 20 are then attached to the swivel stem 24. The threaded connection between the locking nut 22 and the swivel stem 24 is then tightened by hand. The retaining plugs 158 are placed in bores 156 in the locking nut 22. Then allen screws 160 are placed in bores 156 and tightened. If a bearing assembly 122 is included in the swivel pressure head 10, then the needle bearing unit 184 is placed in the lower housing 16 and engages the retainer 188. The lower housing 16 is then placed over the pressure sleeve 20 and locking nut 22. The lower housing 16 is bolted to the swivel motor housing 82 by placing bolts 80 through bores 78 in the flange 76 of the lower housing 16 and through reciprocal bores in the swivel motor housing 82. The bolts 80 are then torqued down. The packing assembly 14 is placed in the upper housing 12. Then the upper housing 12 is placed over the pressure sleeve 20. If alignment pins 96 are included in the swivel pressure head 10, then the upper housing 12 is rotated about the lower housing 16 until the alignment pins 96 drop into place. Then, the upper housing 12 and lower housing 16 are mounted together using the fixation mechanism 18. The fluid lines are then connected to the fluid inlet 36 via the weco flange 44 or to the second fluid inlet 50 in the upper housing.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A swivel pressure head comprising:

an upper housing including a top surface, a bottom surface, an interconnecting side surface, and an internal bore formed by an internal bore wall, the internal bore extending from a fluid inlet to an opening on the bottom surface of the upper housing;

a lower housing including a top surface, a bottom surface, and an interconnecting side surface, the lower housing having a central bore extending from the top surface to the bottom surface, the central bore formed by a central bore wall, the central bore including a reduced diameter upper section and an enlarged diameter lower section;

a fixation mechanism detachably securing the bottom surface of the upper housing to the top surface of the lower housing whereby the internal bore of the upper housing is in communication with the central bore of the lower housing;

a pressure sleeve having an outer cylindrical surface and an internal bore extending from an upper fluid inlet to a bottom fluid outlet, the pressure sleeve including an enlarged outer-diameter bottom section and a reduced-outer diameter extension section, the enlarged outer-diameter bottom section including a top shoulder surface and a bottom surface;

a locking nut operatively engaging the pressure sleeve and configured to operatively engage a swivel stem so that rotation of the swivel stem rotates the pressure sleeve, the locking nut containing an internal bore having an upper portion dimensioned to accommodate the reduced outer-diameter extension section of the pressure sleeve and a lower portion dimensioned to accommodate the enlarged outer-diameter bottom section of the pressure sleeve, the locking nut being positioned within the enlarged diameter lower section of the central bore of the lower housing, the reduced outer-diameter extension section of the pressure sleeve extending upward through the reduced diameter upper section of the central bore of the lower housing and into the internal bore of the upper housing; and a packing assembly positioned in the internal bore of the upper housing, the packing assembly providing a fluid seal between the internal bore wall of the upper housing and the outer cylindrical surface of the pressure sleeve to define a fluid path from the fluid inlet of the upper housing, through the internal bore of the upper housing, and through the upper fluid inlet and internal bore of the pressure sleeve.

2. The swivel pressure head of claim 1, further comprising a bearing assembly positioned within the reduced diameter upper section of the central bore of the lower housing between the central bore wall and the outer cylindrical surface of the pressure sleeve, the bearing assembly receiving a rotational force caused by rotation of the pressure sleeve and providing wear resistance.

3. The swivel pressure head of claim 2, wherein the bearing assembly includes a race and a needle bearing, the race being positioned between the outer cylindrical surface of the pressure sleeve and the needle bearing.

4. The swivel pressure head of claim 3, wherein a retainer secures the needle bearing in the reduced diameter upper section of the central bore of the lower housing.

5. The swivel pressure head of claim 4, wherein the retainer is a circumferential shoulder about a lower end of the reduced diameter upper section of the central bore of the lower housing.

6. The swivel pressure head of claim 4, wherein the retainer is a washer removably attached to the upper end of the enlarged diameter lower section of the central bore of the lower housing, wherein the washer has an inner diameter that is less than an outer diameter of the needle bearing, and wherein the washer has an outer diameter that is larger than the diameter of the reduced diameter upper section of the central bore of the lower housing.

7. The swivel pressure head of claim 1, wherein the packing assembly includes a plurality of packing rings and a spacer ring, the spacer ring being positioned above the plurality of packing rings.

8. The swivel pressure head of claim 1, wherein the reduced-outer diameter extension section of the pressure sleeve includes a middle section having a shoulder surface on the outer cylindrical surface.

9. The swivel pressure head of claim 1, wherein the upper housing further includes a first clamp recess, the lower housing further includes a second clamp recess, and the fixation mechanism includes a clamp disposed in the first and second clamp recesses, the clamp including a first member and a second member, wherein the first and second members are each shaped to fit about the upper and lower housings, the first and second members each including at least two bores on a first end and at least two bolt recesses on a second end, wherein a bolt is positioned within each of the bores of the first member and each of the bolt recesses of the second member in a retaining engagement and a bolt is positioned within each of the bores of the second member and each of the bolt recesses of the first member in a retaining engagement.

10. The swivel pressure head of claim 9, wherein the upper housing further includes at least two recesses in the bottom surface of the upper housing, the lower housing includes at least two recesses in the top surface of the lower housing, and at least two alignment pins are each disposed within one of the recesses in the upper housing and one of the recesses in the lower housing.

11. The swivel pressure head of claim 1, wherein the fixation mechanism includes one or more bolts, the bottom surface of the upper housing includes at least two bolt-receiving bores, and the top surface of the lower housing includes at least two bolt-receiving bores, wherein the bolts are disposed through the bolt-receiving bores in the bottom surface of the upper housing and the bolt-receiving bores in the top surface of the lower housing.

12. The swivel pressure head of claim 1, further including a swivel stem having an upper section with a top surface sealingly engaged to the bottom surface of the enlarged outer-diameter bottom section of the pressure sleeve, the swivel stem including an internal bore in fluid communication with the fluid outlet of the pressure sleeve, wherein the lower portion of the internal bore of the locking nut operatively engages the swivel stem.

13. The swivel pressure head of claim 12, wherein the bottom surface of the enlarged outer-diameter bottom section of the pressure sleeve includes a circumferential recess, and wherein an o-ring is disposed within the circumferential recess to form a fluid seal between the pressure sleeve and the swivel stem.

14. A swivel pressure head comprising:

an upper housing including a top surface, a bottom surface, an interconnecting side surface, and an internal bore formed by an internal bore wall, the internal bore extending from a fluid inlet to an opening on the bottom surface of the upper housing;

a lower housing including a top surface, a bottom surface, and an interconnecting side surface, the lower housing having a central bore extending from the top surface to the bottom surface, the central bore formed by a central bore wall, the central bore including a reduced diameter upper section and an enlarged diameter lower section;

a fixation mechanism detachably securing the bottom surface of the upper housing to the top surface of the lower housing whereby the internal bore of the upper housing is in communication with the central bore of the lower housing;

a pressure sleeve having an outer cylindrical surface and an internal bore extending from an upper fluid inlet to a bottom fluid outlet, the pressure sleeve including an enlarged outer-diameter bottom section and a reduced-outer diameter extension section, the enlarged outer-diameter bottom section including a top shoulder surface and a bottom surface;

a swivel stem having an upper section with a top surface sealingly engaged to the bottom surface of the enlarged outer-diameter bottom section of the pressure sleeve, the swivel stem including an internal bore in fluid communication with the internal bore of the pressure sleeve;

a locking nut operatively engaging the pressure sleeve and the swivel stem so that rotation of the swivel stem rotates the pressure sleeve, the locking nut containing an internal bore having an upper portion dimensioned to accommodate the reduced outer-diameter extension section of the pressure sleeve and a lower portion dimensioned to accommodate the enlarged outer-diameter bottom section of the pressure sleeve and the upper section of the swivel stem, the locking nut being positioned within the enlarged diameter lower section of the central bore of the lower housing, the reduced outer-diameter extension section of the pressure sleeve extending upward through the reduced diameter upper section of the central bore of the lower housing and into the internal bore of the upper housing; and a packing assembly positioned in the internal bore of the upper housing, the packing assembly providing a fluid seal between the internal bore wall of the upper housing and the outer cylindrical surface of the pressure sleeve to define a fluid path from the fluid inlet of the upper housing, through the internal bore of the upper housing, and through the upper fluid inlet and internal bore of the pressure sleeve.

15. The swivel pressure head of claim 14, wherein the locking nut further includes a key extending into the upper portion of the internal bore, wherein the pressure sleeve further includes a reciprocal recess in the top shoulder surface of the enlarged outer-diameter bottom section, and wherein the key engages the reciprocal recess to rotate the pressure sleeve with rotation of the swivel stem.

16. The swivel pressure head of claim 14, wherein the top shoulder surface of the enlarged outer-diameter bottom section includes a key extending away from the shoulder, wherein the locking nut further includes a reciprocal recess in an upper surface of the lower portion of the internal bore, and wherein the key engages the reciprocal recess to rotate the pressure sleeve with rotation of the swivel stem.

17. The swivel pressure head of claim 14, wherein the top surface of the upper housing includes a recess for removably receiving a lifting ring.

18. The swivel pressure head of claim 14, wherein the top surface of the upper housing further includes a second fluid inlet in fluid communication with the internal bore of the upper housing.

19. The swivel pressure head of claim 14, wherein the upper portion of the swivel stem is threadedly connected within the lower portion of the internal bore of the locking nut, and wherein one or more retaining plugs are each disposed within a bore through the locking nut to engage the swivel stem for retaining the swivel stem within the lower portion of the internal bore of the locking nut.

20. A method of using a swivel pressure head comprising the steps of:

a) providing a swivel pressure head comprising: an upper housing including a top surface, a bottom surface, an interconnecting side surface, and an internal bore formed by an internal bore wall, the internal bore extending from a fluid inlet to an opening on the bottom surface of the upper housing; a lower housing including a top surface, a bottom surface, and an interconnecting side surface, the lower housing having a central bore extending from the top surface to the bottom surface, the central bore formed by a central bore wall, the central bore including a reduced diameter upper section and an enlarged diameter lower section; a fixation mechanism configured to detachably secure the bottom surface of the upper housing to the top surface of the lower housing to place the internal bore of the upper housing in communication with the central bore of the lower housing; a pressure sleeve having an outer cylindrical surface and an internal bore extending from an upper fluid inlet to a bottom fluid outlet, the pressure sleeve including an enlarged outer-diameter bottom section and a reduced-outer diameter extension section, the enlarged outer-diameter bottom section including a top shoulder surface and a bottom surface; a locking nut containing an internal bore having an upper portion dimensioned to accommodate the reduced outer-diameter extension section of the pressure sleeve and a lower portion dimensioned to accommodate the enlarged outer-diameter bottom section of the pressure sleeve; and a packing assembly configured to fit within the internal bore of the upper housing;

b) attaching the pressure sleeve and the locking nut to a swivel stem of a swivel so that rotation of the swivel stem rotates the pressure sleeve, wherein the reduced outer-diameter extension section of the pressure sleeve is positioned through the upper portion of the internal bore of the locking nut, and wherein the enlarged outer-diameter bottom section of the pressure sleeve and an upper portion of the swivel stem are positioned within the lower portion of the internal bore of the locking nut;

c) attaching the lower housing to an upper surface of the swivel to position the locking nut within the enlarged diameter lower section of the central bore of the lower housing, and to position the reduced outer-diameter extension section of the pressure sleeve through the reduced diameter upper section of the central bore of the lower housing, wherein the lower housing is bolted to the upper surface of the swivel;

d) positioning the packing assembly within the internal bore of the upper housing; and e) attaching the upper housing to the lower housing with the fixation mechanism so that the reduced outer-diameter extension section of the pressure sleeve extends into the internal bore of the upper housing, wherein the packing assembly provides a fluid seal between the internal bore wall of the upper housing and the outer cylindrical surface of the pressure sleeve to define a fluid path from the fluid inlet of the upper housing, through the internal bore of the upper housing, and through the upper fluid inlet and internal bore of the pressure sleeve.

21. The method of claim 20, further comprising the steps of:

f) attaching a fluid line to the fluid inlet of the upper housing; and g) flowing a fluid through the fluid inlet and the internal bore of the upper housing, through the upper fluid inlet, the internal bore, and the lower fluid outlet of the pressure sleeve, and into a central bore of the swivel stem.

22. The method of claim 20, wherein in step (a) the fixation mechanism includes a clamp including a first clamp member and a second clamp member; wherein step (e) further comprises engaging a first clamp recess of the upper housing and engaging a second clamp recess of the lower housing with the first and second clamp members, and securing the first and second clamp members together.

* * * * *